US005606720A

United States Patent [19]

Verhoest et al.

[11] Patent Number: 5,606,720

[45] Date of Patent: Feb. 25, 1997

[54] PHOTOGRAPHIC PROCESSING APPARATUS

[75] Inventors: Bart Verhoest, Kontich; Jan Claes, Mortsel; Freddy van Humbeeck, Keerbergen, all of Belgium

[73] Assignee: AGFA-Gevaert N. V., Mortsel, Belgium

[21] Appl. No.: 260,913

[22] Filed: Jun. 15, 1994

[30] Foreign Application Priority Data

Jul. 5, 1993 [EP] European Pat. Off. ..... 93201957

[51] Int. Cl.[6] ..... G03D 3/08

[52] U.S. Cl. ..... 396/620; 396/622

[58] Field of Search ..... 354/317–324, 354/339, 301; 226/57; 156/64; 118/126; 100/153; 355/27, 286, 75, 76

[56] References Cited

U.S. PATENT DOCUMENTS

| | | | |
|---|---|---|---|
| 3,559,558 | 2/1971 | Hamlin et al. | 354/317 |
| 3,595,206 | 7/1971 | Larimer | 118/126 |
| 3,724,734 | 4/1973 | Sachtleben et al. | 226/57 |
| 4,232,959 | 11/1980 | Ateya et al. | 355/286 |
| 4,305,768 | 12/1981 | Lontz | 156/64 |
| 4,551,878 | 11/1985 | Turley et al. | 100/153 |
| 4,760,416 | 7/1988 | Hehn | 354/320 |
| 4,998,130 | 3/1991 | Ibuchi et al. | 354/301 |
| 5,049,921 | 9/1991 | Sonobe et al. | 355/27 |

*Primary Examiner*—D. Rutledge
*Attorney, Agent, or Firm*—William J. Daniel

[57] ABSTRACT

Apparatus for processing a photographic sheet material in at least one processing stage which includes a feed roller array for transporting the material to or from the stage. The feed roller array has a pair of rollers supported on shafts for rotation and mounted with one superposed generally above the other. The upper roller is driven in a transport direction by a drive mechanism acting on an end of its shaft. The opposite ends of the shafts of the two rollers are journaled in frame members with the lower roller being supported for limited independent movement toward and away from the upper roller. The lower roller is normally biased into contact with the upper roller and is adapted to be displaced vertically away from the upper roller by a cam arrangement acting on the ends of its shaft. The upper roller is adapted to be shifted axially to disengage an end of its shaft from its journal to permit the upper roller to be removed manually from the apparatus.

10 Claims, 14 Drawing Sheets

PHOTOGRAPHIC PROCESSING APPARATUS

FIELD OF THE INVENTION

This invention relates to apparatus for the processing of photographic sheet materials and particularly for developing exposed photographic material, and more particularly to apparatus for developing lithographic offset printing plates.

BACKGROUND OF INVENTION

In an apparatus or system for the development of aluminium lithographic printing plates of the type disclosed in EP 410500, during processing the photographic sheet material it is an advantage if the carry over from one chemical bath to another chemical bath is kept to a minimum. It is therefore known to use pairs of squeegee rollers at the exit of a chemical bath to remove excess chemicals from the sheet material as it exits the bath. A good removal of processing liquid is also required to reduce the drying time of the sheet material after the last process bath, and hence to reduce the energy use.

In order to obtain good imaging quality it is necessary for the rollers at the exit of each bath, hereinafter called "squeegee rollers", to exert a load in the order of 0.5–6.0N per cm roller length to remove excess processing materials. To this end the rollers are biased together, typically by springs which act on the ends of the roller shafts.

Since the rollers have an elastomeric surface, if the apparatus is left with the squeegee rollers biased together, even without any processing fluid being present, the sqeegee rollers may become temporarily deformed. When the apparatus is restarted this may result in poor quality image reproduction for the first few plates processed on the restart, after which the deformation disappears.

During the processing of the photographic material, which typically includes a coating containing gelatin, any "processing roller", including a squeegee roller as well as another roller, can become coated with gelatin. If the apparatus is switched off with the rollers stationary, some disturbing crystalisation on the rollers may occur, which may reduce the quality of the printing plates to be processed. Moreover, if the apparatus is switched off with the rollers stationary and any roller pair biased together, then the rollers may become glued together by the dried gelatin. As a result the roller surfaces may become damaged, and the drive gears may also be damaged when the apparatus is restarted.

In EP application 92203312.1 (filed on 28 Oct. 1992) a solution to the above-mentioned problem is described, comprising ingeneous mechanisms. However, if some excessive developing material is contaminating said mechanisms, the effective reliability of the processing apparatus may be seriously decreased.

OBJECTS OF INVENTION

The present invention seeks to provide an improved solution to the above problem of rollers adhering together when the processing apparatus is idle.

SUMMARY OF THE INVENTION

According to the present invention there is provided an apparatus for processing photographic sheet material including at least a first and a second processing roller rotatable on respective first and second roller shafts, said first and said second processing roller being placed one above the other and biased together, characterised in that there is provided at least at one end of at least said first roller shaft a rotating means for transporting said sheet material in the processing direction and at each end of at least said second roller shaft, a displacement means operably connected with said second roller shaft for relative displacement of said second roller away from and to said first processing roller.

By the term "roller shaft" at least three different mechanical possibilities are included, namely a) the case of a roller shaft formed integrally with the processing roller, b) the case of a separate roller shaft extending through the axis of the processing roller, and c) the case of a roller shaft separately affixed to an endflange of the processing roller.

BRIEF DESCRIPTION OF THE DRAWINGS

The invention will be described by the following illustrative embodiments with reference to the accompanying drawings without the intention to limit the invention thereto, and in which.

DETAILED DESCRIPTION OF THE INVENTION

Figure 1:
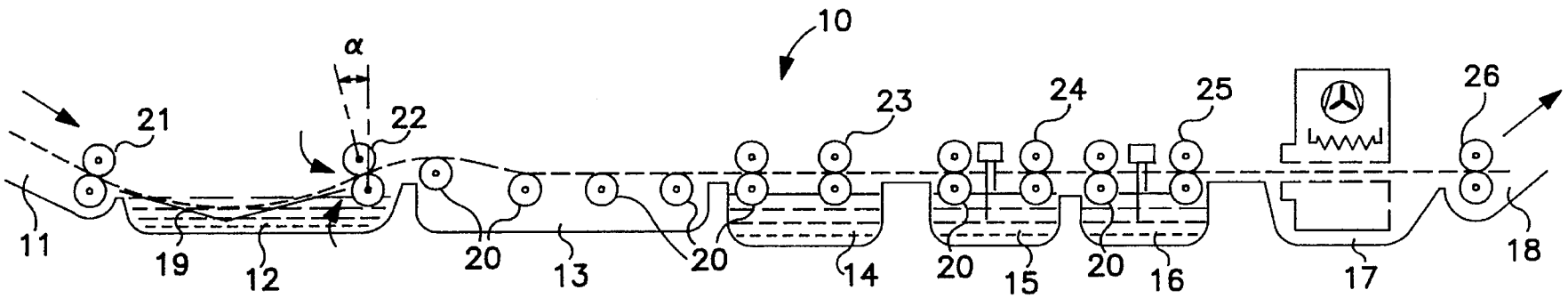
FIG. 1 is a schematic longitudinal layout of a embodiment of a processing apparatus according to the invention.

With reference to FIG. 1 there is illustrated a longitudinal section through an apparatus 10 for processing exposed photographic sheet material, in particular lithographic printing plates, of the type described in EP-A-410500.

EP-A-410500 disclosed an imaging element containing an aluminium support provided with in the order given an image receiving layer and a silver halide emulsion. In the document there is disclosed a diffusion transfer reversal process (hereinafter called "DTR process") for obtaining a lithographic printing plate in which said imaging element is imagewise exposed and subsequently developed using a developing liquid or activating liquid in the presence of a silver halide complexing agent. The imaging element is then guided through a diffusion transfer zone so that the silver halide complexes formed during the development step are allowed to diffuse into the image receiving layer where they are converted to silver. When the imaging element leaves the diffusion transfer zone a silver image is formed in the image receiving layer. The now useless photosensitive layer and optional other layers above the image receiving layer are then removed by guiding the imaging element through a washing section and through a rinsing station. Finally the element now carrying a silver image on its surface is treated with a finishing liquid that contains a so called hydrophobizing agent for improving the hydrophobicity of the silver image.

In the above described method for obtaining an aluminium based lithographic printing plate according to the DTR process generally at least three different liquids are used i.e. a developing or activating liquid, a rinsing liquid and a finishing liquid.

The processing apparatus 10 (FIG. 1) is mounted within a generally rectangular housing which may include a rectangular metal mainframe (not shown for reason of simplicity) for supporting the various sections of the apparatus. The apparatus 10 thus may-comprise a sheet feed means 11, preferably a pair of feeding rollers 21, a developing section 12, a diffusion transfer section 13, a wash section 14, a rinse section 15, a finishing section 16, a drier section 17, and an output section 18 with output rollers 26. All these sections may include conveyor rollers 20. The exit ends of the developing section 12, the washing section 14, the rinsing station 15 and the finishing section 16 may have sets of squeegee rollers 22, 23, 24 and 25 to remove excess liquid from the sheet material as it exits the respective section. Since each set of said squeegee rollers 22, 23, 24 and 25 is identical, only one set of rollers 22 will be described. Moreover, since also the other pairs of rollers, as the rollers 20 at the entrance of any bath, have the same construction (but reduced biasing pressure) and the same problems of deformation of the rollers and adherence of chemicals to the rollers (but at a reduced rate), all roller pairs will hereinafter be called "processing rollers", including squeegee as well as non squeegee rollers.

If in FIG. 1 the upper roller of said processing rollers is rotating anticlockwise and both said processing rollers are biased together, e.g. by springs means, the lower roller of said processing rollers is driven clockwise to pass sheet material through the rollers and towards the output 18 of the processing apparatus 10.

In order to break the meniscus of any process liquid resting on the processing rollers when the apparatus 10 is idle, a socalled displacement means is foreseen by which one of said processing rollers is able to displace between e.g. 1–6 mm away from the other of said processing rollers.

Before explaining all details of the present invention, first a quick cross reference is made to several drawings, which gives a general survey of the sequential steps used in the apparatus of the present invention. Hereto, a general reference is made first to FIG. 2 which is an elevation of the rollers in the rollers closed condition; to FIG. 3 which is an elevation of the rollers in open condition; to FIG. 4 which is an elevation of the rollers in open and shifted condition; to FIG. 5 which is an elevation of the rollers with the upper roller in tilted condition and to FIG. 6 which is an elevation of the rollers with the upper roller taken away.

In order to be as clear as possible in the full description to be given hereinafter, it may be noted that some different mechanical means of the processing apparatus 10 according to the present invention will be treated partially sequentially and partially simultaneously, while fullfilling each a separate function. Said different mechanical means will be indicated further on as "rotating means" for transporting the sheet material in the processing (preferably horizontal) direction and a "displacement means" for relative movement (preferably in vertical direction) of one processing roller away from and to the other processing roller.

Figure 2:
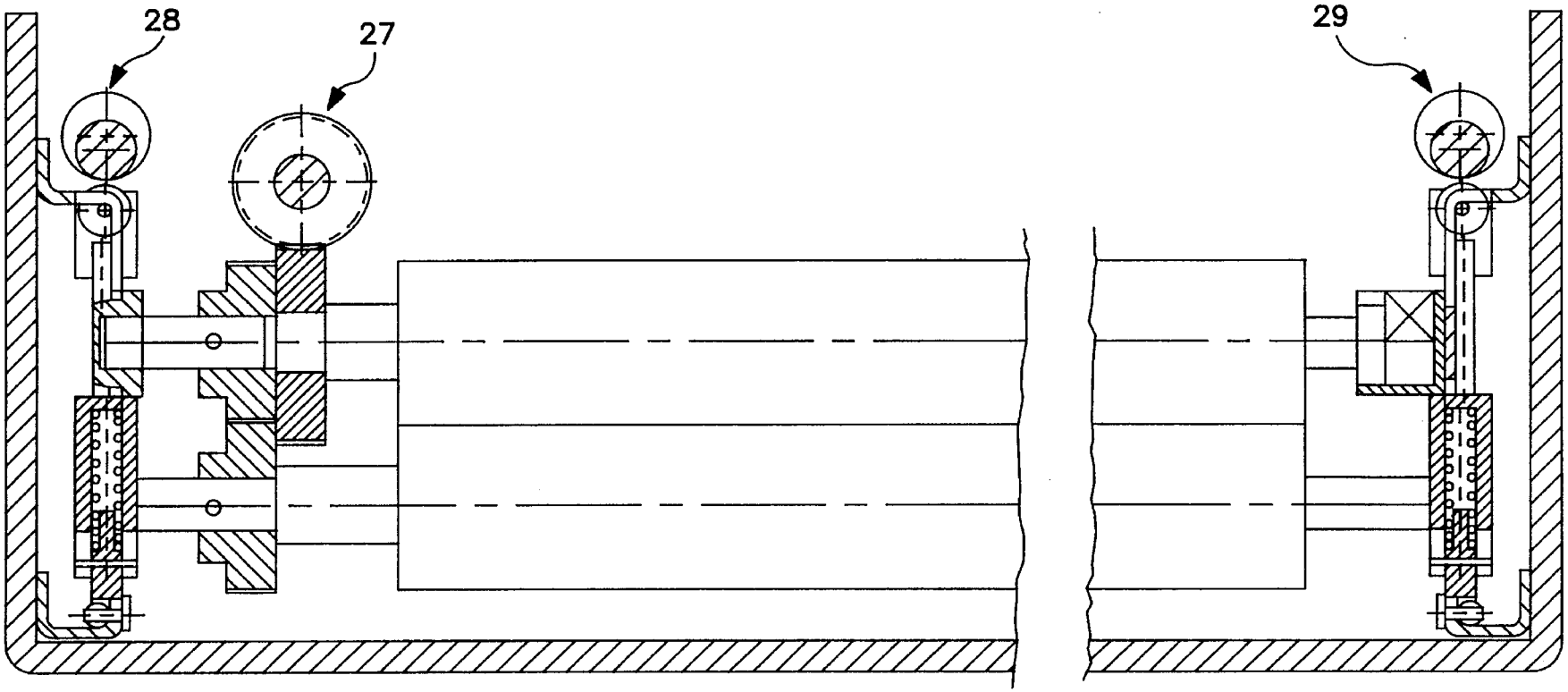
FIG. 2 is an elevation of the rollers in the rollers closed condition.

Making reference to FIG. 2, which is an elevation of the processing rollers in the rollers closed condition, the main parts of said rotating means are designated 27, whereas the main parts of said displacement means are designated 28 for the socalled "drive side or left side" and designated 29 for the socalled "take away side or right side". It will be understood that in the present description the terms "right side" and "take away side" are equivalent, since in the accompanying drawings, as e.g. FIG. 5, one of the processing rollers can be easily taken away from the right side of the apparatus. (The obvious alternative of constructing a "take away side" at the left side of the developing apparatus clearly also falls within the protection of the present application.) The same equivalency applies to the terms "drive side" and "left side".

The detailed functioning and components of said means 27, 28, 29 are explained hereinafter.

All the rollers 20 to 26 may be linked by a single drive shaft 30 (see FIG. 3) to operate simultaneously to advance sheet material through the apparatus 10 from the feed means 11 to the output section 18. And each set of processing rollers 22 may comprise a first roller 31 (FIG. 3), and a second roller 32. Said first roller 31 is preferably fixed on respective shafts 33 and 34 for rotation; said second roller 32 is preferably fixed on respective shafts 35 and 36 for rotation.

An apparatus 10 according to the present invention is further characterised in that said roller shafts 33, 34, 35, 36 are mounted at each end in bearings held in respective subframes so that said first processing roller 31 is an upper roller and said second processing roller 32 is a lower roller.

The present invention provides an apparatus 10 for processing photographic sheet material including at least a first and a second processing roller 31,32 supported by respective first and second roller shafts, said first and said second processing roller being placed one above the other and biased together, characterised in that there is provided at least at one end of at least said first roller shaft a rotating means for transporting said sheet material in the processing direction and at each end of at least said second roller shaft, a displacement means operably connected with said second roller shaft for relative displacement of said second roller 32 away from and to said first processing roller 31.

Figure 15A:
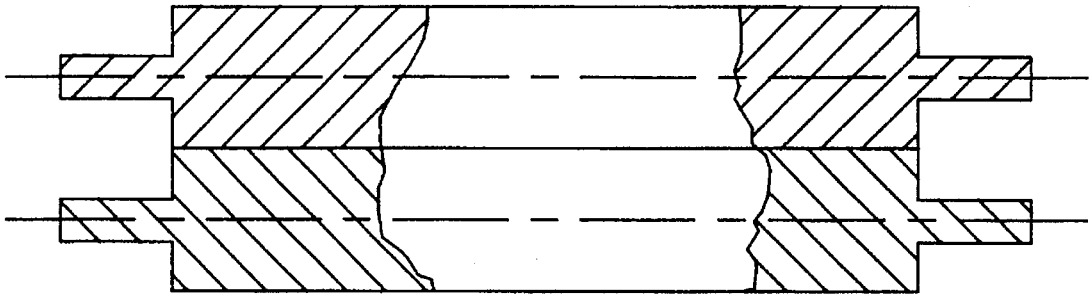
FIGS. 15A, 15B, and 15C give a schematic longitudinal section of three different roller shaft mountings.
Figure 15B:
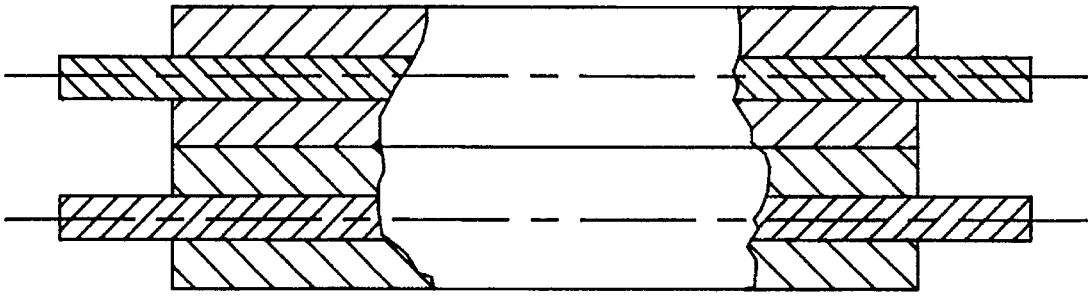
Figure 15C:
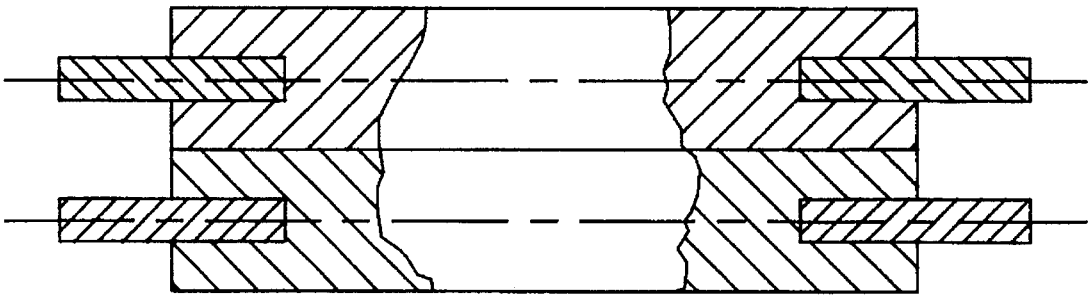

The present description is of a preferred embodiment of the processing rollers 31, 32 wherein each of said rollers is constructed by assembling a hollow cylinder covered with a suitable elastomer, and fitting at each end of said cylinder a rigid flange and a shaft (indicated by the references 33, 34, 35 and 36). Although normally each processing roller thus incorporates 2 roller shafts, also a construction wherein a cylindrical roller is assembled with a single roller shaft, axially passing through the entire cylinder, can also be used in accordance with the present invention. Even the possibility of constructing said processing roller from a massive cylindrical roller with integral shafts can also be used in accordance with the present invention. Reference is made to FIG. 15 giving a schematic longitudinal section of three different roller shaft mountings.

Thereabove, the longitudinal section of said processing rollers 31, 32 does not necessarily have to be strictly cylindrical, as other forms may also fit for the required purposes. Thus, also parabolic or barrel type processing rollers 31, 32 fall within the scope of the present application.

Figure 4:
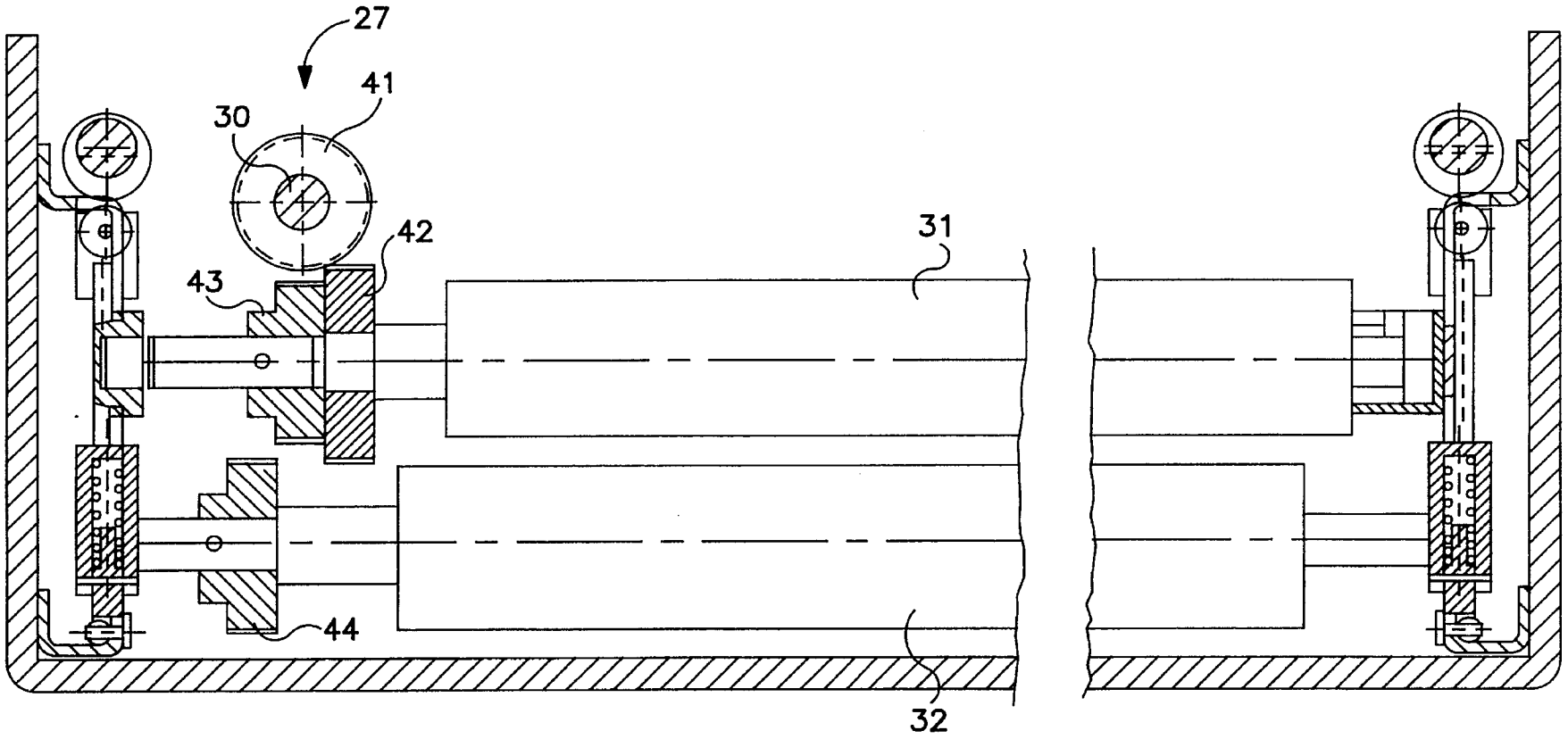
FIG. 4 is an elevation of the rollers in open and axially shifted condition.

From FIG. 4, which is an elevation of the processing rollers in open and axially shifted condition, it is seen that the rotating means 27 preferably comprises a mechanical transmission for driving said first processing roller 31 and a set of cooperating gears located at one end and at the same side of both roller shafts 33, 35.

More specifically, according to a preferred embodiment of the present invention, the upper processing roller 31 is driven at one end thereof through gears 41 and 42, by the drive shaft 30. More preferably, said transmission comprises a wormscrew 41 and a wormwheel 42. The lower processing roller 32 is preferably driven by a helical gear 44 that meshes with another helical gear 43. All said gears 41, 42, 43 and 44 are preferably mounted thus that resulting axial forces on said roller shafts 33, 35 are directed towards the frame at the drive side of the apparatus 10.

Furthermore, the rotating means is driven preferably by an electromotor with an encoding disc system (not shown) in order to control the speed and the progressing horizontal position of the sheet material.

Figure 5:
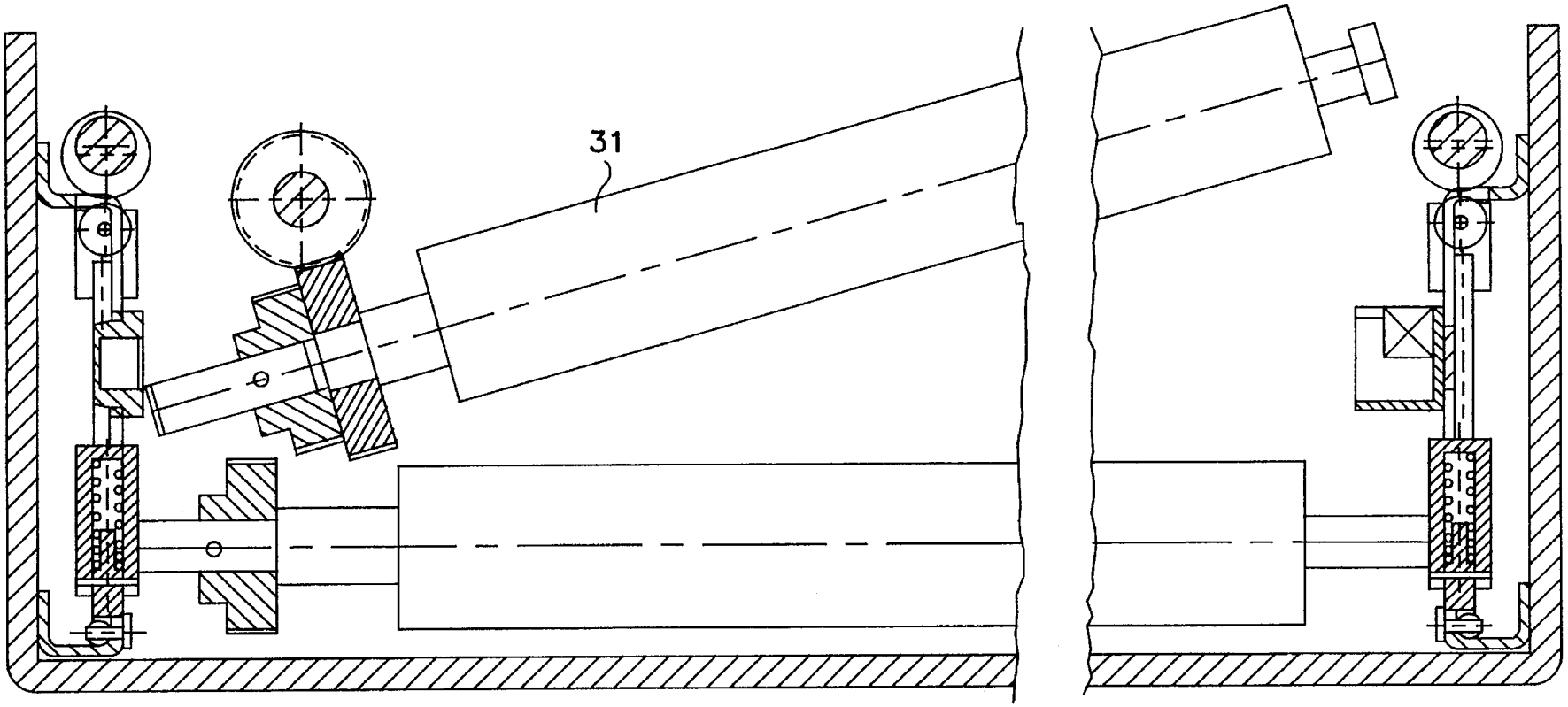
FIG. 5 is an elevation of the rollers with the upper roller in tilted condition.
Figure 6:
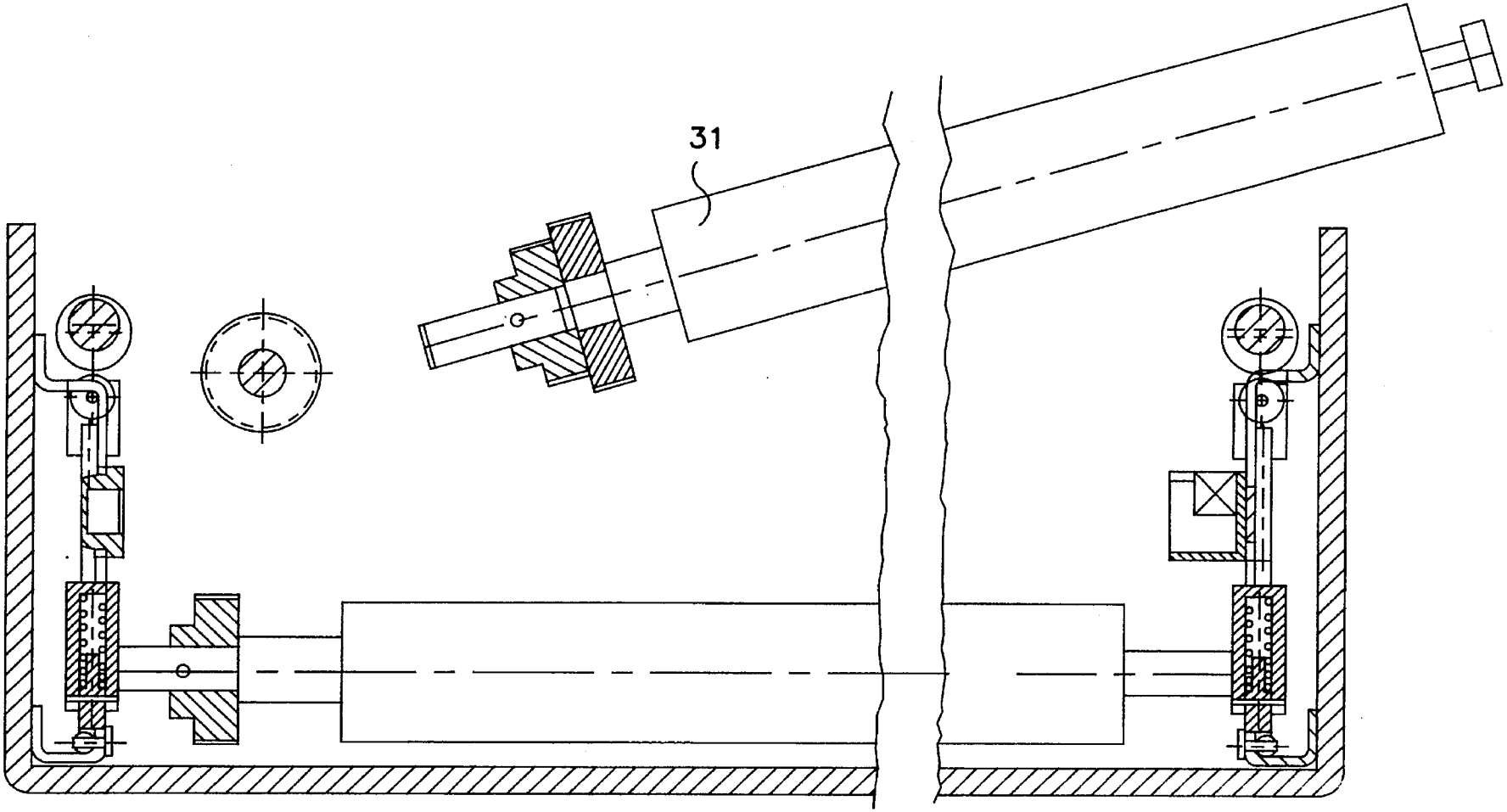
FIG. 6 is an elevation of the rollers with the upper roller taken away.

Thanks to a specially designed bearing system (to be explained in full detail further on) of the processing rollers, the upper roller can easily be shifted axially, then tilted and taken away manually, allowing for convenient maintenance. These steps are clearly indicated in the FIGS. 5 and 6. Herein, FIG. 5 is an elevation of the rollers with the upper roller 31 in tilted condition, and FIG. 6 is an elevation of the rollers with the upper roller 31 taken away.

Figure 7A:
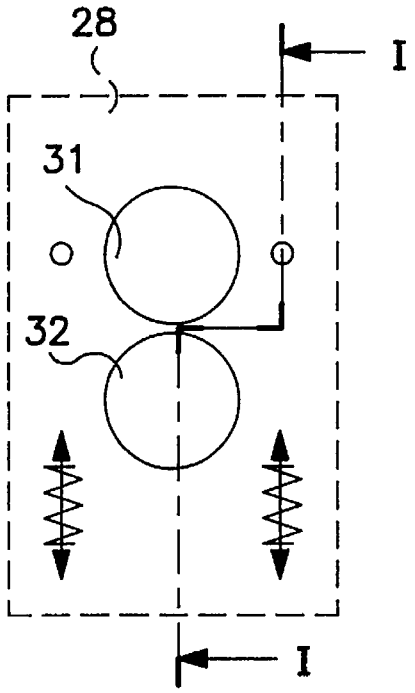
FIGS. 7A, 7B, and 7C are a schematic cross sectional layout of a set of processing rollers indicating the fixing positions of the upper roller and the spring positions of the lower roller.
Figure 7B:
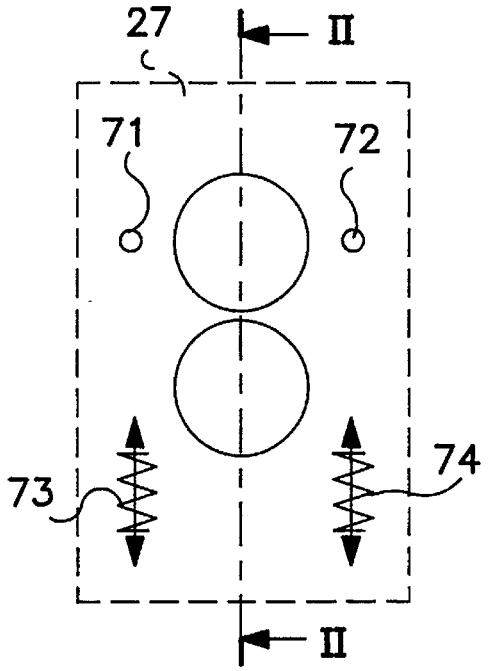
Figure 7C:
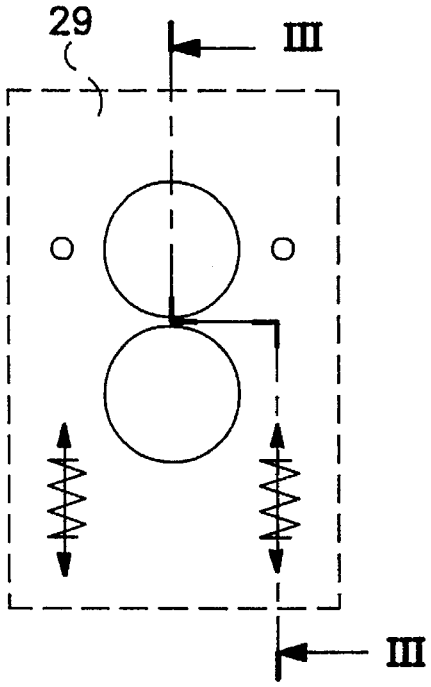
Figure 8:
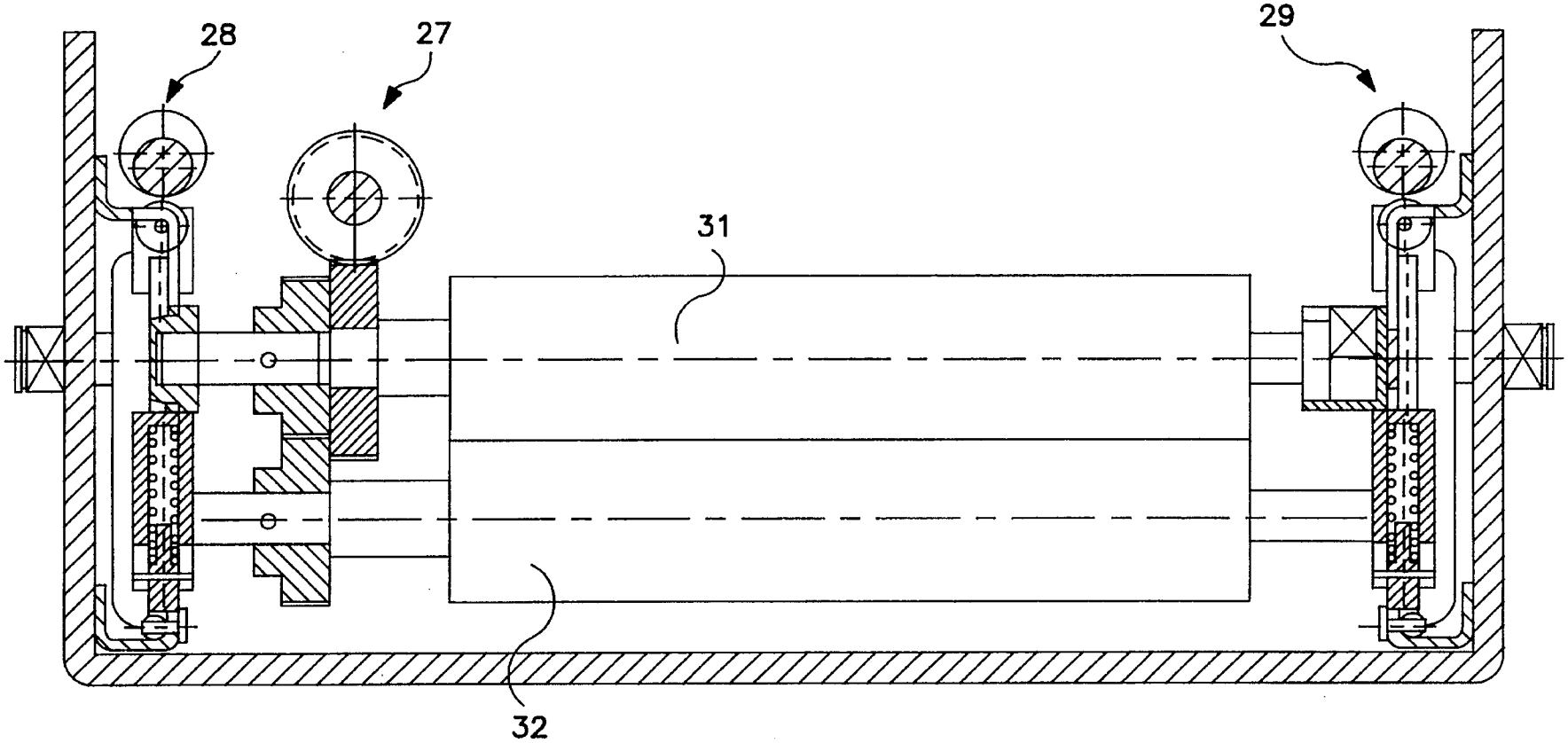
FIG. 8 is a longitudinal section of a preferred embodiment of a processing station according to the present invention.

Before describing the subassemblies and the relevant parts of the rotating and the displacement means 27, 28, 29 reference is made now to FIG. 7 and to FIG. 8. FIG. 7, is a schematic cross sectional layout of a set of processing rollers 31, 32 indicating the fixing positions 71, 72 of the upper roller 31 and the spring positions 73, 74 of the lower roller 32. In order to make the descriptions which have to be followed further on as clear as possible, the just mentioned schematic cross sectional layout is divided in three different cross sectional layouts numbered respectively FIG. 7.1, FIG. 7.2 and FIG. 7.3. The principal difference between the three layouts of FIG. 7 consists in the indication of 3 different sections, namely a line I—I through the displacement means 28 of the drive side, a line II—II through the rotating means 29 and a line III—III through the displacement means 29 at the take away side.

In common to all three layouts, the horizontal and the vertical coordinates of the upper roller 31 are precisely located in the frame of the processing apparatus 10, preferably by fixing means 71 and 72 which will be detailed further on. Also in common to all said three layouts, the horizontal and the vertical position of the spring means are precisely located in the frame of the processing apparatus 10, preferably by the vertical guiding means 73 and 74 which will be detailed further on.

FIG. 8 is a longitudinal (relative to the roller axes) section of a preferred embodiment of a processing station according to the present invention. For sake of greater clarity, it is noted that FIG. 8 is a composite sectional view, incorporating three different sections. Herein, the left side 28 is taken along line I—I of FIG. 7.1; the rotation means 27 and the processing rollers 31, 32 are taken along line II—II of FIG. 7.2 and the right side 29 is taken along line III—III of FIG. 7.3. By integration of said three sections into one and same FIG. 8, a very concise but complete disclosure is provided. Nevertheless all relevant parts will be hereinafter described in full technical detail.

Figure 9A:
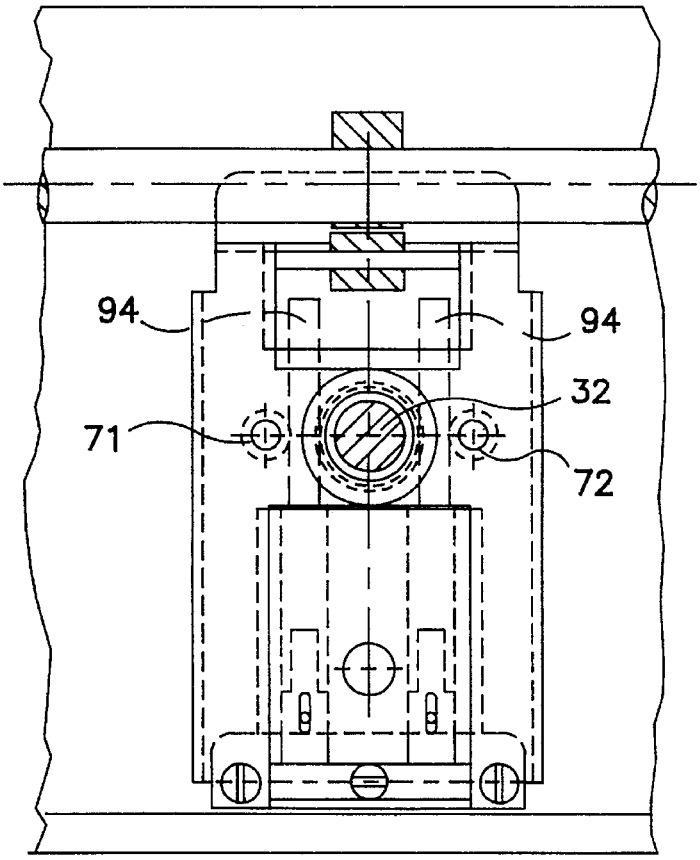
FIGS. 9A, 9B are a detailed views of the left side of a preferred embodiment of the displacement means according to the present invention.
Figure 9B:
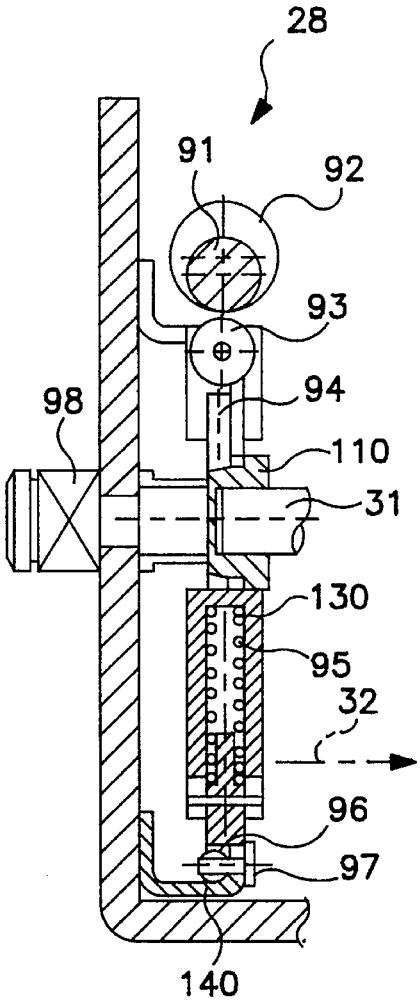
Figure 10A:
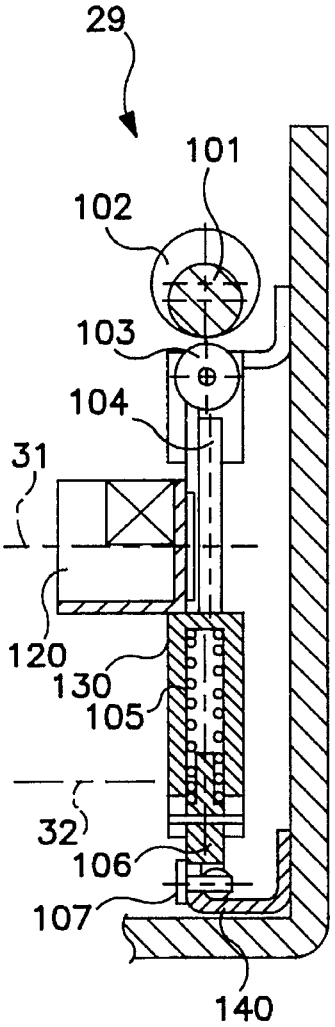
FIGS. 10A, 10B are a detailed views of the right side of a preferred embodiment of the displacement means according to the present invention.
Figure 10B:
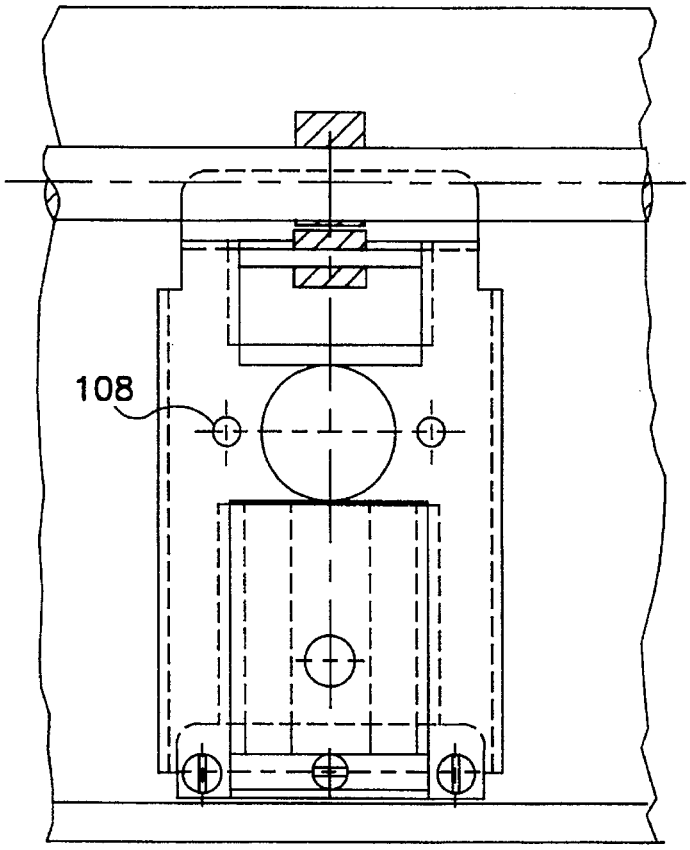
Figure 11:
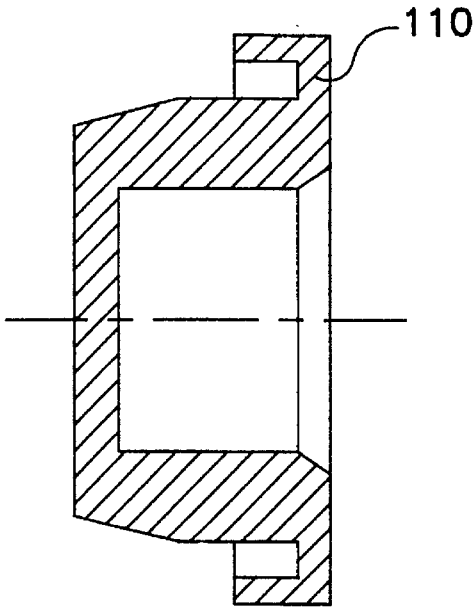
FIG. 11 is a longitudinal section of a preferred embodiment of an upper bearing at the left side according to the present invention.

In doing so, reference is made now to FIGS. 9 and 10. FIG. 9 is a detailed view of the drive side of a preferred embodiment of the displacement means 28 according to the present invention. FIG. 10 is a detailed view of the take away side of a preferred embodiment of the displacement means 29 according to the present invention.

As seen in FIG. 9 and in FIG. 10, the upper processing roller 31 is located within bearings 110 (at the drive side) and 120 (at the take away side); the lower roller 32 is located within 2 bearing plates 130, which plates preferably are identical for both sides of the apparatus 10.

Said bearings 110, 120 and bearing plates 130 may preferably be formed from a suitable polymer material with good characteristics, as regarding a low friction relating to metals, no contamination nor degradation, suitable for mass production etc., and may consist of e.g. nylon or acetal resin.

The coordinates of the upper processing roller 31 are defined by the end bearings 110 and 120 whose coordinates in the apparatus 10 themselves are precisely defined by suitable fixing means 71, 72 (see FIG. 7) from the supporting subframes 140 to the mainframe of said apparatus 10. More in particular, said fixing means 71, 72 may preferably be realised by well designed bolts 98, 108 (see FIGS. 9 and 10), having a precise and ridgid geometry.

Figure 3:
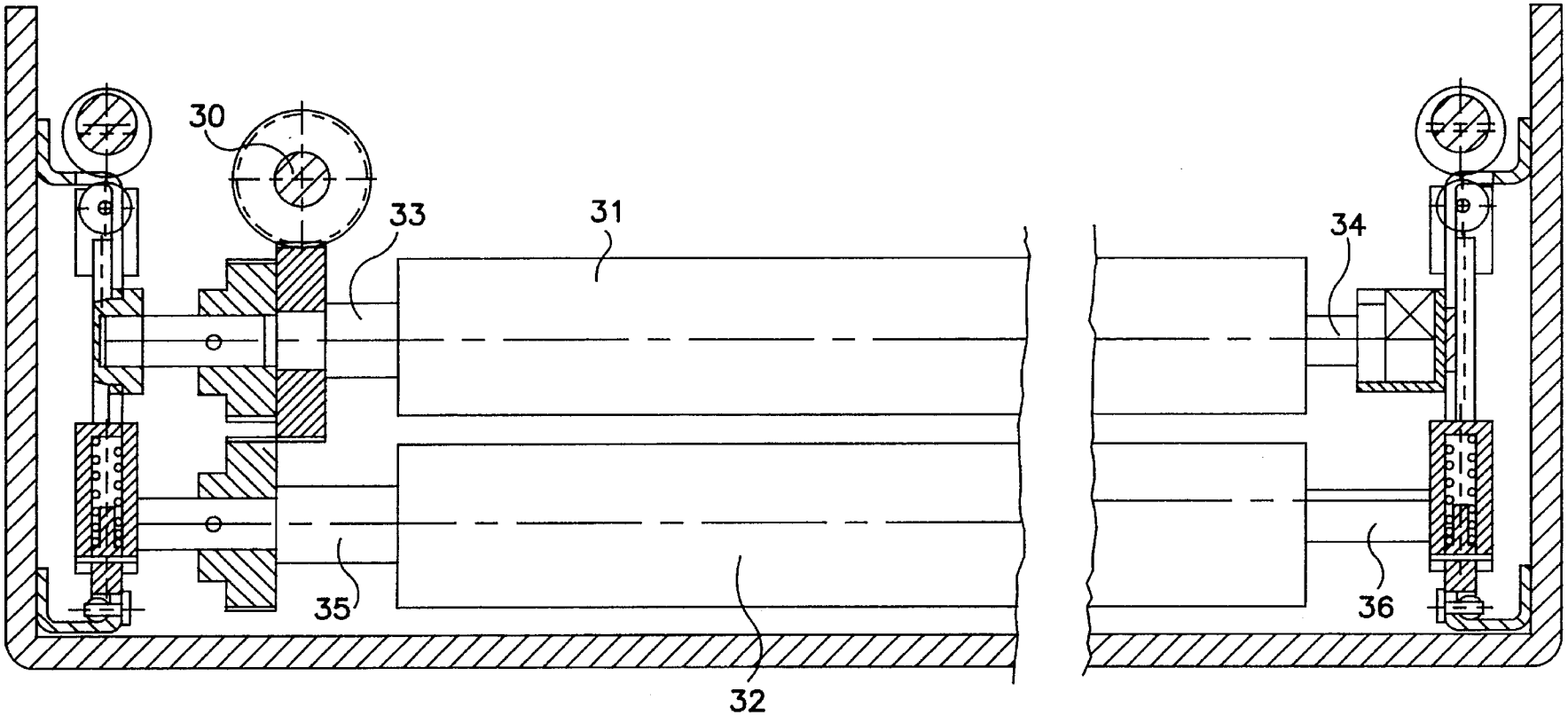
FIG. 3 is an elevation of the rollers in open condition.
Figure 13A:
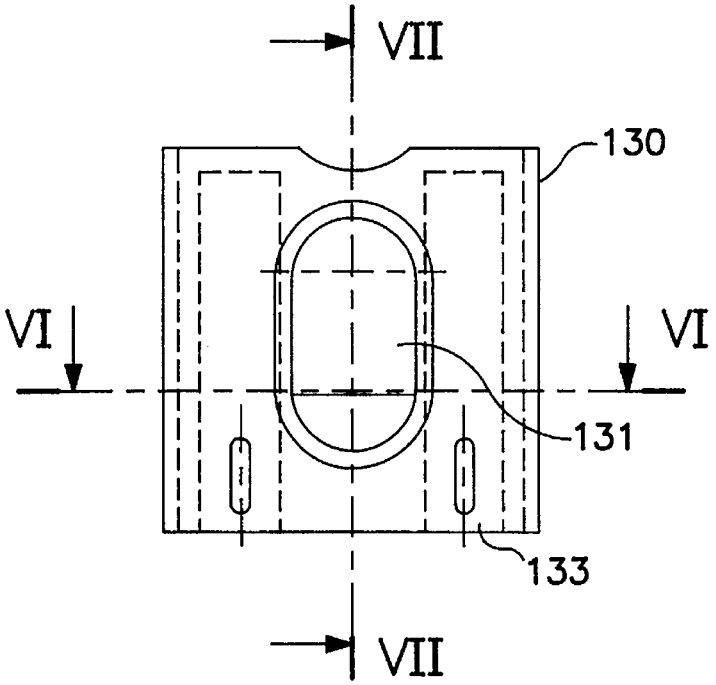
FIGS. 13A, 13B, and 13C give a plan view, an upper view in crossection and a side view in crossection of a preferred embodiment according to the present invention of a lower bearing plate.
Figure 13B:
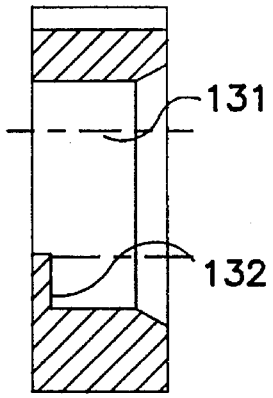
Figure 13C:
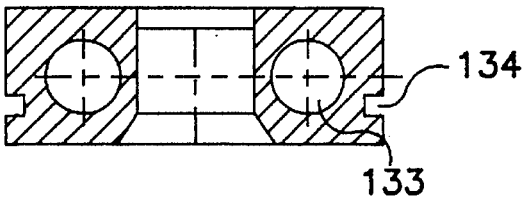
Figure 14A:
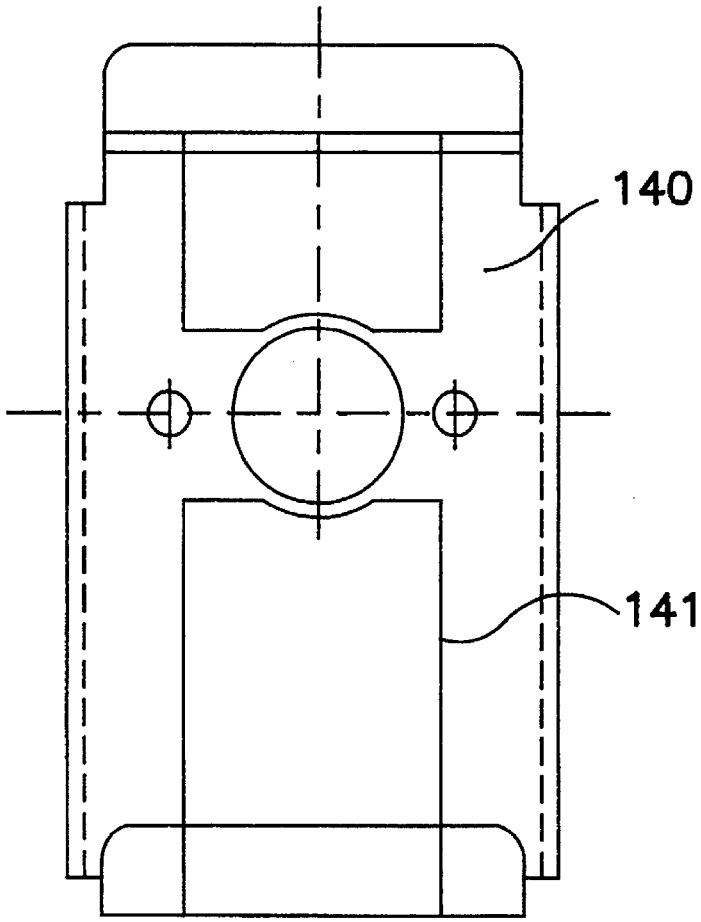
FIGS. 14A, and 14B give a plan view and a side view of a preferred embodiment of a subframe according to the present invention.
Figure 14B:
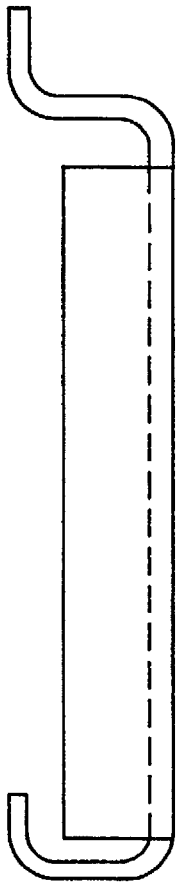

The lower roller 32 rotates in two bearing plates 130 and said bearing plates 130 (described extensively further on in reference to FIG. 13) may slide vertically in guides 141 in the subframes 140 (described extensively further on in reference to FIG. 14) so that the lower roller 32 is free to move towards and away from the upper roller 31 as the processing rollers move between the positions shown in FIGS. 2 and 3.

Apart from the already described components of the apparatus 10 according to the present invention, said displacement means 28, 29 further may comprise a camshaft 91, 101, an eccentric cam 92, 102 and a cam roller 93, 103 and four tappets 94, 104 for each displacable processing roller 32. Furthermore, said bearing plates 130 are guided in the subframes 140 by means of two sleeves 134, against the force of a compression spring means 95, 105, which fits in a cilindrical chamber 133 of said bearing plates 130 and which is abutting against a stud 96, 106 and an endstop 97, 107 in the subframe 140.

Said tappets 94, 104 are mounted 2 at each side of the apparatus (see FIG. 9) and are pushing away the respective bearingplates 130 under influence of the excentric cams 92, 102 and against the spring means 95, 105. Thereabove, said tappets 94, 104 preferably are interchangeable at different tappet lengths, making it thus possible to correct eventual geometrical variations in the apparatus 10.

Said spring means 95, 105 bias the lower roller 32 towards the upper roller 31 by a force of preferably up to 400N and may consist of compression springs 95, 105 or of equivalent compression means, as e.g. an elastomer, or a pneumatic or a hydraulic cylindre.

Furthermore, the camshafts 91, 101 may each be driven by a synchronised electromotor with an encoding disc system (not shown) in order to control the vertical displacement of the displacable processing roller 32.

The excentric cams 92, 102 on the camshafts 91, 101 are preferably each held in an "at rest" position by an index disc (not shown) on the respective motor drive. This sets the starting position for the operation of the eccentric cams 92,102. For example the eccentric 92, 102 can be made to move apart over the first 180 degrees of rotation of the cam 102, be held apart at a preset distance for 60 degrees of rotation, and then move together over the last 120 degrees of rotation.

When the camshaft 91, 101 now turns, the eccentric cam 92, 102 has its cam surface working against the cam roller 93, 103 to push the lower processing roller 32 against the bias of the springs 95, 105 away from the upper roller 31 (see FIGS. 3, 8 and 9) and thus opening the processing rollers. This breaks the meniscus of any fluid caught between said processing rollers 31, 32 when the apparatus 10 is idle.

Beneath the purpose of achieving a high reliability of the processing apparatus 10, it is also important to reduce the unevitable "downtimes" to a minimal loss. Therefor, the apparatus of the present invention also includes a very easy manipulation of the processing rollers 31, 32. As well the upper processing roller 31 as the lower processing roller 32 may be mounted or taken away by simple actions. Whereas FIGS. 2 to 6 already gave a survey on this manipulation, now a deeper insight may be given.

Figure 12A:
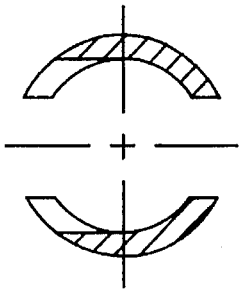
FIGS. 12A, 12B, and 12C give a longitudinal view and two crosssections of a preferred embodiment of an upper bearing at the right side according to the present invention.
Figure 12B:
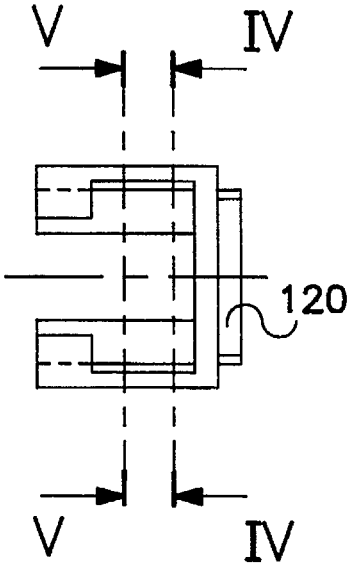
Figure 12C:
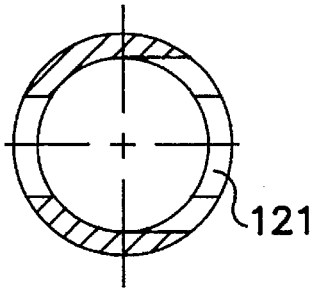

The upper and the lower roller 31 and 32 are driven rollers. The two rollers 31, 32 rotate in bearings 110, 120, 130 respectively which are held in a pair of subframes 140 located one at each end of said rollers. The upper roller 31 rotates in bearings 110, 120 fixed in the subframes 140 and is rotated by a wormwheel 42 which is driven by a worm screw 41. In reference to FIG. 12, it will be noted that the bearing 120 of the upper processing roller 31 at the take away side of the apparatus 10, clearly has an open upper end 121 to allow easy bringing in or take away of said upper processing roller 31.

If no processing rollers 31, 32 have yet been mounted into the processing apparatus, first the lower processing roller 32 may be manually introduced in the lower bearing plates 130. Thus a lower roller is tilted and shifted so that roller shaft 35 can be brought into said bearing plates 130. Because of a special design of the respective chamber 131 in said bearing plates 130 (see FIG. 13) with a dedicated geometry and dedicated free spaces, the lower roller 32 may be easily and loosely mounted, whereby its axial position is restricted by two collars 132 in said bearing plates 130.

After bringing in the lower roller 32, also the upper processing roller 31 may be introduced easily, also by tilting and shifting, as illustrated in FIG. 4 and 5.

As mentioned above, all transmission gears 41, 42, 43 and 44 are preferably mounted thus that resulting axial forces on the roller shafts 33, 35 are directed towards the frame at the drive side of the apparatus 10. Therefor, as soon as the processing appartus is working, both rollers will automatically be shifted towards the drive side of the frame, without leaving any disturbing space.

The axis of rotation of the two processing rollers 31 and 32, respectively, may be offset by a small angle $\gamma$ (see FIG. 1), preferably between 0° and 10°, from the vertical towards the feed side of the rollers so that if necessary the rollers 31, 32 are arranged in a line normal to an inclined feed surface.

Where a plurality of the above sets of rollers 22 are utilized in the apparatus 10 the eccentric cams 92, 102 can be made to operate simultaneously or in step wise progression whichever is desired. In the preferred embodiment the eccentric cams 92, 102 operate simultaneously.

We claim:

1. Apparatus for processing photographic sheet material including first and second processing rollers each being mounted on a roller shaft, said first and second processing rollers being arranged with the first roller is superposed position generally above the second roller, biasing means normally biasing said second roller into contact with the first roller, each of said processing rollers having opposite ends of its shaft journaled for relative rotation in bearings supported in corresponding subframes, drive means at one end of the shaft of said first roller for rotating said first roller to transport said sheet material in a processing direction, and at each end of the shaft of said second roller, a displacement means operative to displace the shaft of said second roller bodily in a generally vertical direction against said biasing means to thus move said second roller out of contact with said first processing roller, at least one end of the first roller shaft being engaged in generally telescoping relation in its bearing and the shaft of said first roller being axially slidable in the bearings therefor a sufficient distance to disengage said one end from its bearing for manual removal of the shaft of said first roller from said bearings.

2. Apparatus according to claim 1, including a frame for supporting said subframes at opposite ends of the roller shafts and wherein said driving means further comprises a transmission comprising a wormscrew rotated by a motor and a wormwheel fixed on said end of the shaft of said first processing roller for driving said first processing roller and a set of two cooperating helical gears located at one end and at the same side of both roller shafts, and mounted such that axial forces imparted to said roller shafts are directed towards the frame corresponding to said one end of the shaft from said first roller at the drive side.

3. Apparatus according to claim 1 wherein said driving means comprises a motor having an encoding disc system to control the speed and processing position of said sheet material.

4. Apparatus according to claim 1 wherein said displacement means comprises cam means at each end of the shaft of said second roller, said cam means being actuable to control the movement of the ends of said second roller.

5. Apparatus according to claim 4 wherein said cam means comprises rotatable eccentric discs.

6. Apparatus according to claim 4 wherein said displacement means further comprises a cam follower rollers engaged by said cam means to displace the ends of the shaft of said second roller away from the shaft of said first roller.

7. Apparatus according to claim 6 wherein the subframes for the opposite ends of the shaft of said second roller are supported for generally vertical movement and include removable tappets supporting said cam follower rollers, said tappets being interchangeable with a plurality of different vertical extents whereby the vertical adjustment of the ends of the shaft for said second roller can be adjusted by replacing said tappets with others of idfferent vertical extents.

8. Apparatus according to claim 1 wherein the axis of said first processing roller is displaced away from a true vertical plane passing through the axis of said second roller by a small angle in the direction of said processing direction whereby said sheet material transported by said rollers follows a slightly downwardly inclined path.

9. Apparatus according to claim 1 which further comprises means acting on the shaft of said first roller to apply thereto a force urging the roller in a direction to maintain said one end of the shaft of said first roller in telescoping relation with the bearing for such one end.

10. Apparatus according to claim 9 wherein said drive means at said one end of the shaft of said first roller comprises a wormwheel fixed on said one end of said shaft, a driving wormscrew engaging said worm wheel to drive the same and rotate said shaft, and wormwheel and said wormscrew cooperating to exert on said shaft an axial force maintaining said one end of said shaft in said telescoping relation with its bearing and being adapted to be brought out of engagement when said shaft is axially moved to disengage its one end from the bearing in which said one end is fitted.

* * * * *